United States Patent [19]

Davis et al.

[11] Patent Number: 4,863,764

[45] Date of Patent: Sep. 5, 1989

[54] FIRE RETARDING POLYPROPYLENE FIBER AND FABRIC AND METHOD FOR PREPARING

[75] Inventors: Gayron N. Davis, Opelika; Henry W. Haynes, Sr., Valley, both of Ala.; Dhan N. Parekh, Columbus, Ga.

[73] Assignee: West Point Pepperell, Inc., West Point, Ga.

[21] Appl. No.: 204,934

[22] Filed: May 31, 1988

Related U.S. Application Data

[63] Continuation-in-part of Ser. No. 943,101, Dec. 18, 1986, abandoned.

[51] Int. Cl.[4] ..... B05D 3/02

[52] U.S. Cl. ..... 427/393.3; 427/389.9

[58] Field of Search ..... 427/393.3, 389.6

[56] References Cited

U.S. PATENT DOCUMENTS

| | | | |
|---|---|---|---|
| 2,413,163 | 12/1946 | Bacon | 427/393.3 |
| 2,549,059 | 4/1951 | Creely | 427/393.3 |
| 2,640,040 | 5/1953 | Seyb et al. | 427/393.3 |
| 3,955,032 | 5/1976 | Misihuton | 427/393.3 |
| 4,623,583 | 11/1986 | Mischuton | 427/393.3 |

*Primary Examiner*—Thurman K. Page
*Assistant Examiner*—L. R. Horne

[57] ABSTRACT

A method for achieving the flame retardancy of polypropylene fiber and for fabrics which include such fibers has been devised which has a low add-on finish. The finish comprises a mixture containing a bromochlorinated paraffin having a high concentration of bromine, up to 80% by weight, but, notwithstanding low add-on, the invention will produce an extremely effective fire retardancy where the bromine and chlorine constituents equal 20% and 40% respecively by weight of the bromochlorinated paraffin. Antimony oxide, preferably a antimony pentoxide is used, having a preferred particulate size in the range of 30–50 millimicrons. The quantity of antimony oxide to be used may be $\frac{1}{3}$ mole to 1 mole of bromine. After the bromochlorinated paraffin is combined with emulsifiers to form a stable premix, the premix and antimony pentoxide are preferably combined with a binder consisting of an ethylacrylate latex. The foregoing mixture is used as a finish for polypropylene fibers or fabrics and when applied, produces a dry weight gain no greater than 5%–30%; however, for certain applications where seamslippage of the fabric is not important, the binder may be omitted. Since the binder is approximately 50% of the total weight when the binder is used, the coating without binder will produce a gain of 2.5% to 15% with only 8% gain as an average.

14 Claims, No Drawings

FIRE RETARDING POLYPROPYLENE FIBER AND FABRIC AND METHOD FOR PREPARING

This is a continuation-in-part of U.S. application Ser. No. 943,101, filed on Dec. 18, 1986, now abandoned.

BACKGROUND OF INVENTION

The use of polypropylene as a textile fiber has a greatly increased in recent years. Various physical characteristics of polypropylene in fiber form and in knit or woven fabrics can be quite attractive and recent developments in formulations for producing polypropylene fibers have produced fabrics with greatly improved hand, and drape, color retention, etc. However, to the present applicant's knowledge, no successful methods for producing a fire retarding polypropylene has been found which can pass the NFPA (National Fire Protection Association) 701 vertical test and which does not so greatly alter the physical characteristics of such fabrics so that the basic attractiveness and utility of the polypropylene fiber has been rendered essentially worthless. One of the basic reasons for this result is that the addition of flame retardant chemicals according to current methods to produce the desired effect is in the range of 50%–80% by weight of polypropylene. Not only can this method be prohibitively expensive but also the important physical characteristics of the fabric greatly deteriorate.

One of the problems associated with the flame retardancy of polypropylene is caused by its high heat of combustion (11,600 cal/g) where for example cotton, polyester and rayon have heats of combustion which are respectively 4,330, 6,170 and 3,446 cal/g. Another problem is its relatively low Limiting Oxygen Index (LOI), i.e. 18.6, which is defined as the minimum percentage of oxygen in the environment (e.g. air) necessary to sustain combustion.

Additives used for the flame retardation of polypropylene include the use of halogens, chlorine or bromine with and without antimony oxide as a synergist and phosphorus compounds. Flame retardant agents are sometimes added to the melt before spinning to give some fire retardancy and bromine compounds are favored over chlorine compounds as being more effective for polypropylene fire retardancy. Heretofore, the use of these compounds has not permitted polypropylene to pass NFPA 701. The use of decabromodiphenyl oxide "Deca" with antimony oxide as a synergist in combination with a halogenated binder such as PVC has been recommended. However, so much chemical has been required to produce some flame retardant characteristics in polypropylene that the fabric weight is increased by 50–80%. Furthermore, deca is expensive ($1.15 per sq. yd.) and is a solid chalky powder which gives a scratchy feel to the fabric causes the fabric to turn white.

The method of the present invention has succeeded in producing acceptable fire retardancy for polypropylene fibers as a spin finish, as well as woven polypropylene fabrics used as wall and panel fabrics and upholstery. Fabrics treated in accordance with the method of the invention successfully pass the stringent National Fire Protection Association vertical test NFPA 701 without first having to remove coning oils, i.e., surface oils which were added to aid yarn handling and wearing. The treated fibers and the fabrics so treated have superior hand and drape and are resistant to seam-slip.

Flame retardancy continues throughout 25 washings. The chemical treatment is inexpensive and is less that 1/10 of the cost of less effective treatments recommended in the literature.

SUMMARY OF INVENTION

In accordance with the present invention, method for achieving the flame retardancy of polypropylene fibers and for fabrics which include such fibers has been devised which has a low add-on finish for fabrics or a spin finish for fibers. The finish comprises a mixture containing a bromochlorinated paraffin having a high concentration of bromine, up to 80% by weight, but, notwithstanding low add-on, the invention will produce an extremely effective fire retardancy where the bromine and chlorine constituents equal 20% and 40% respectively by weight of the bromochlorinated paraffin. Antimony oxide, preferably a antimony pentoxide is used, having a preferred particulate size in the range of 30–50 millimicrons. The quantity of antimony oxide to be used may be $\frac{1}{3}$ mole to 1 mole of bromine. After the bromochlorinated paraffin is combined with emulsifiers to form a stable premix, the premix and antimony pentoxide can be suitably combined with a binder such as of an ethylacrylate latex.

The foregoing mixture is used as a finish for polypropylene fibers or fabrics and when applied, produces a dry weight gain no greater than 5%–30%; however, for certain applications where seam-slippage of the fabric is not important, the binder may be omitted. Since the binder is approximately 50% of the total weight when the binder is used, the coating without the binder will produce a gain of 2.5% to 15% with only 8% gain as an average.

Although the presence of a binder provides some help to stabilize the loose weaves and gives a somewhat improved seam strength, the binder can suitably be substantially reduced if sticking of the yarns is experienced or the fabric is rather stiff and does not drape as well as is desired. Additional benefits can be achieved by not using any binder at all. This improves fire retardancy, since the binder itself is often a flammable compound.

The finish of the fiber or the fabric is dried, suitably in the vicinity of 250° F. The most suitable temperature for any particular fiber, coating composition and condition can be determined by routine experimentation.

In the case of a binderless coating, it would seem that the bromochloroparaffin migrates into the surface of the fiber and this assures the required permanence of the treatment. A less oily feel is obtained in this case and it appears that the fiber might even be somewhat plasticized by the treatment. The result is a better draping fabric. When a binder is used, it would appear that the bromochloroparaffin is bound more within the binder which then bonds to the fiber surface. In this case the fiber and the fabric woven from it appears to be somewhat stiffer.

As the term "effective temperature" is used throughout the specification and claims, it is intended to denote the temperature found most effective to provide appropriate permanency to the flame retardant treatment and to establish other desired properties. It is expected that the effective temperature will not exceed 250° C., because the supplier of the bromochloroparaffin indicated that it might start to dehalogenate at that temperature. An even lower practical maximum is compelled by the fact that most commercial polypropylene fibers start to melt at 300° F.

BRIEF DESCRIPTION OF PREFERRED EMBODIMENT(S)

Flame Retardant Coating For Polypropelene Fabrics.

According to one example used to practice the present invention, a bromochlorinated liquid paraffin is combined with an antimony synergist and a latex binder (which is optionally added), the aforesaid mixture unexpectedly producing excellent results as a treatment at low add-on levels. Solids add-on of the brominated compound according to the invention for example provides fire retardancy in the range of 2%–4%, whereas the recommended amount previously used has been in the range of 10%–20% of the bromine constituent. The finished weight gain (including binder) is about 16%, while previously the weight gain has been in the range of 50%–70%. The bromochlorinated paraffin may contain approximately equal proportions of bromine and chlorine, for example 30% Br and 30% Cl; but in general, much higher percentages of bromine (up to 80%) should produce greater flame retardancy. However, an acceptable fire retardency will be produced where the bromine constituent is as low as 20% and the chlorine constituent is 40%.

The bromochlorinated paraffin is a sticky liquid which is prewarmed and high shear emulsified with an ethylene oxide non-ionic surfactant emulsifier and with a phosphated alcohol anionic surfactant emulsifier. Blended emulsifiers of nonionic and anionic nature often perform better. Water is added while shearing and the color changes amber to a white emulsion indicating a phase change. Only enough water is added to make a viscous emulsion having the consistency of mayonnaise providing approximately 15,000 centipoise. At this viscosity, the heavier bromine compound cannot satisfy and the resulting premix is stable for reasonable storage.

Antimony pentoxide ($Sb_2O_5$) colloidal dispersions are preferred over $Sb_2O_3$ products because such dispersions are more efficient due to their colloid size and reduce settling of solids. Antimony pentoxide is the main synergist with bromine, but phosphate from the emulsifier may act as a synergist also. Approximately $\frac{1}{3}$ mole of antimony per mole of bromine is a good working porportion of these components.

A binder may be required to reduce seam-slippage in the sewing of polypropylene fabrics. The most effective binders for FR purposes have been acrylic type latexes, usually containing an acrylonitrile group in the polymer. Organic nitrogen compounds from nitrile give a synergistic effect with phosphorous which may be available from the phosphated alcohol. There may in fact be two FR systems at work in the preferred system, antimony/halide and the nitrogen/phosphorous system.

Halogen containing binder latexes have not been found to be effective in this FR system. No halogen containing binder latex has been found which when used on polypropylene fabric will pass NFPA 701. Various PVC and vinylidene chloride latexes with and without FR plasticizers (phosphate) have been tried and fail to pass NFPA 701 notwithstanding that they lend more halogen (chlorine) to the composite. As mentioned, a binder may not be needed at all in the system if seam slippage is not a problem.

The final flame retardant or finish is formulated by mixing the emulsified premix containing the bromochlorinated paraffin with antimony pentoxide and the binder. Ammonia is added to stabilize the antimony pentoxide dispersion in the mix and enough should be added to keep pH above 9.0 in the pad bath (during treatment of fabrics).

This formula is typically applied to polypropylene fabrics at a wet pickup range of 70%–100%, based on its unfinished weight. This results in a finished weight gain of about 16% which would be reduced to about 8% if a binder is not used.

SPECIFIC EXAMPLE

The following sets forth a specific example of a formulation which may be applied as a finish to polypropylene fibers or fabrics. The various chemical preparations have been identified by their chemical means and also by the corporate source designations used to comprise the specific example, such corporate source designations being those which existed at the time this application was filed. Following the specific example the properties and chemical content of each of the corporate source designations has been given.

| Chemical Designation | Corporate Source Designation | Lbs |
|---|---|---|
| | Part A (Premix Emulsion) | |
| 1. Phosphated Alchohol anionic surfactant emulsifier | Griffwet PA-8 | 10 |
| 2. Ethylene oxide non-ionic surfactant emulsifier | Triton X-155 | 20 |
| 3. Bromochlorinated paraffin 30% Br, 30% Cl (approx.) | Pearsall ID-4338-A | 300 |
| Water | | |
| | Part B (Final Finish) | |
| 4. Water | | 456 |
| 5. Anionic colloidal dispersion of antimony pentaoxide in water | Nyacol 1550 | 16.6 |
| 6. Aqueous $NH_3$ (28% Ammonia) | | 7 |
| 7. Premis (Part A) | | 106 |
| 8. Ethylacrylate latex | | 166 |
| 9. Defoamer | | 2 oz. |

Homogenize with Cowles mixer for 5 minutes. Pour in 45 lbs. of water while mixing. Continue mixing for 5–10 minutes or until smooth. Total premix = 375 lbs. at 80% ID-4338-A Cover mixer propeller with water before adding constituents. Mix well, but do not make foam.

An even simpler, binderless fire retardant system is formulated from:

colloidal antimony pentoxide (50% wt soln.) 0.8% wt (Nyacol 1550)

Amonia to pH=8–9 bromochloroparaffin (premulsified, 80% wt active) 8.1% wt (Pearsall 59-5C)

Defoamer, non-siliconic (Drew Chemical is Y-250) 0.01% wt

The defoamer is not an essential ingredient, but its use is preferred. Any commercially available defoamer can be suitably used.

Properties and names and addresses of corporate sources of above constituents by reference number 1. Griffwet PA-8 an anionic phosphated alcohol surfactant.

Properties

-continued

| Properties and names and addresses of corporate sources of above constituents by reference number | |
|---|---|
| Appearance - colorless liquid | |
| Chemical Nature - anionic | |
| Active Indredients - %, 31.0 ± 0.5 | |
| pH - 7.3 ± 0.2 | |
| Weight per Gallon - lb., 8.8 | |
| Grifftex Chemical | |
| Cunningham Drive | |
| Molika, Alabama 36801 | |
| Triton X-155 an ethylene oxide non-ionic surfactant emulsifier | |
| Properties | |
| % of Active Ingredient for 25 Sec. Wetting | 1.56 |
| Calculated HLB Value | 12.5 |
| Physical Form | Visc. Liquid |
| Typical Color | Amber |
| Flash Point $^0F^a$ | $128^m$ |
| Pour Point $^0F^a$ | 0 |
| Brookfield Viscosity cps at 25° C. (12 rpm) | 790 |
| Density at 25° C. lbs/gal | 8.8 |
| Rohm and Haas | |
| Independence Mall West | |
| Philadelphia, Pennsylvania 19105 | |
| 3. Pearsall ID-4338-A a bromochlorinated paraffin | |
| Properties | Typical |
| Total Halogen content, % as Cl | 47 |
| Chlorine, Wt. % | 33 |
| Bromine, Wt. % | 31.5 |
| Specific Gravity @ 25° C. | 1.59 |
| Viscosity, SUS @ 210° F. | 80 |
| Viscosity, SUS @ 100° F. | 5000 |
| Viscosity, poise @ 25° C. | 80 |
| Color, Gardner | 2 |
| Stability, JQD, % HCl | 1.2 |
| Pearsall Chemical Division, Witco Corporation | |
| P.O. Box 42817 | |
| Houston, TX 77242 | |
| 4. Nyacol 1550 an antimony pentoxide colloidal dispersion in water. | |
| % antimony pentoxide | 50 |
| pH | 4–6 |
| viscosity, centipoise | 10 |
| specific gravity | 1.81 |
| particle size of oxide | 15.30 millimicrons |
| Nyacol Products Inc. | |
| an affiliate of The PQ Corporation | |
| P.O. Box 349 | |
| Ashland, Mass 01721 | |

It will be understood that the foregoing description has been of preferred embodiment(s). In order to understand the scope of the invention, reference should be made to the appended claims.

We claim:

1. The method for achieving fire retardancy of polypropylene fibers which comprises forming a mixture of: a bromochlorinated paraffin wherein the percentage of bromine is in the range of 20–80% of such compound and an antimony oxide selected from the group consisting of antimony pentoxide and antimony trioxide having an particulate size within the range of 30–50 millimicrons; the proportion of said antimony oxide to bromochlorinated paraffin being within the range of from one-eighth to one mole of said antimony oxide to 1 mole of bromine; and applying said mixture as a treatment having 2–15% dry weight relative to said polypropylene fibers.

2. The method according to claim 1 wherein said bromochlorinated paraffin contains approximately 30% bromine and 30% chlorine and the proportion between said antimony oxide and bromine is approximately $\frac{1}{3}$ mole of said antimony oxide and 1 mole of bromine; and wherein the weight of said treatment is approximately 8% dry weight relatives to said polypropylene fibers.

3. The method according to claim 1 wherein said antimony oxide component is a colloidal aqueous dispersion of antimony pentoxide.

4. The method according to claim 1 in which a premix is prepared by combining the bromochlorinated paraffin and a blended emulsifier having nonionic and anionic constituents, the mixture being subjected to high shear with the addition of water to form a stable white emulsion, the emulsion substantially inhibiting stratification of the heavy bromine containing component.

5. The method according to claim 1 in which a binder is added to said mixture which is an acrylic latex containing a acrylonitrile group, the percentage of binder in the mixture being 30–60% of said mixture.

6. A fire retardant treatment for propylene fibers which comprises forming a mixture of a brominated paraffin and antimony oxide, wherein the percentage of bromine is in the range of 20–80% and said antimony oxide has a particulate size within the range of 30–50 millimicrons and said antimony oxide being a colloidal aqueous dispersion of antimony pentoxide, the proportion of said antimony oxide to bromochlorinated paraffin being within the range of from one-eighth to one mole of said antimony oxide to 1 mole of bromine, and applying the aforesaid mixture as a treatment having 2–50% dry weight relative to said polypropylene fibers.

7. The fire retardant treatment according to claim 6 wherein said bromochlorinated paraffin contains approximately 30% bromine and 30% chlorine and the proportion between said antimony oxide and bromine; and is approximately $\frac{1}{3}$ mole of said antimony oxide and 1 mole of bromine; and wherein the weight of said treatment or coating is approximately 8% dry weight relative to said polypropylene fibers.

8. The fire retardant coating according to claim 6 in which a binder is added to said mixture which is an acrylic latex containing a acrylonitrile group, the percentage of binder in the mixture up to 60% of said mixture.

9. The method of claim 1, further comprising drying the mixture at an effective temperature.

10. The process of claim 9, wherein said effective temperature is from 250° F. to 300° F.

11. The method of claim 1, wherein the fiber to which said mixture is applied is woven into a fabric prior to the application of said mixture.

12. The fire retardant treatment of claim 6, further comprising drying the mixture at an effective temperature.

13. The process of claim 12, wherein said effective temperature is from 250° F. to 300° F.

14. The method of claim 6, wherein the fiber to which said mixture is applied is woven into a fabric prior to the application of said mixture.

* * * * *